US005762229A

United States Patent [19]

Tatsu et al.

[11] Patent Number: 5,762,229

[45] Date of Patent: Jun. 9, 1998

[54] APPARATUS FOR PREVENTING WET DAMAGE CAUSED BY DEW-DROPS INSIDE CONTAINER

[75] Inventors: Hisataka Tatsu, Kagoshima; Michiharu Suzuki, Funabashi, both of Japan

[73] Assignees: Kawasaki Kisen Kaisha, Ltd.; Ogawa Tent Co., Ltd., both of Tokyo, Japan

[21] Appl. No.: 876,207

[22] Filed: Jun. 16, 1997

[30] Foreign Application Priority Data

Feb. 21, 1997 [JP] Japan ..... 9-000923 U

[51] Int. Cl.[6] ..... B65D 5/46

[52] U.S. Cl. ..... 220/403; 220/426; 220/462; 220/463

[58] Field of Search ..... 220/403, 404, 220/410, 426, 461, 460, 462, 463; 229/117.23

[56] References Cited

U.S. PATENT DOCUMENTS

| | | | |
|---|---|---|---|
| 5,253,775 | 10/1993 | Gould | 220/403 |
| 5,282,544 | 2/1994 | Boots | 220/403 |
| 5,465,863 | 11/1995 | Seick et al. | 220/403 |
| 5,492,270 | 2/1996 | Avery et al. | 220/403 |
| 5,639,164 | 6/1997 | Ishino et al. | 220/403 |
| 5,653,354 | 8/1997 | Olson | 220/403 |

*Primary Examiner*—Joseph M. Moy
*Attorney, Agent, or Firm*—Kane,Dalsimer,Sullivan, Kurucz, Levy, Eisele and Richard, LLP

[57] ABSTRACT

An apparatus for preventing wet damage caused by dew-drops inside a hexahedral container, comprising: a plurality of suspending rings attached onto inner wall surface portions of the container; an inner bag constituted by a ceiling face, a bottom face, two side faces, a front face and a rear face so as to be shaped into a hexahedron, the inner bag having a loading opening formed in one of the side faces for loading cargoes; a plurality of suspending hooks provided on the inner bag so as to be hooked on the plurality of suspending rings of the container so that the inner bag loaded with the cargoes is suspended inside the container in a manner so as to keep its hexahedral shape substantially; an absorptive sheet attached on an outside of the ceiling face of the inner bag; and an air permeable sheet attached to the side faces and rear face of the inner bag so that air inside the inner bag can circulate through the air permeable sheet; whereby the cargoes loaded in the inner bag can be prevented from wet damage, or damage caused by dry rot, mold or the like caused by saturated damp air.

9 Claims, 3 Drawing Sheets

APPARATUS FOR PREVENTING WET DAMAGE CAUSED BY DEW-DROPS INSIDE CONTAINER

BACKGROUND OF THE INVENTION

1. Field of the invention

The present invention relates to an apparatus for preventing wet damage caused by dew-drops inside a container (BULK DEW SAFE).

2. Description of the related art

Conventionally, cargoes such as coffee beans, grains and so on were bagged for transportation. The bagged cargoes were loaded up in a container, and desiccating agents or water/moisture absorptive sheets or paper were used for preventing wet damage. However, the water/moisture absorption was not satisfactory, and the transportation cost such as labor costs in loading and landing ran up to a large sum.

Conventional sheets for preventing wet damage caused by dewdrops used a method of putting desiccating agents in an inner bag, or a method of using a moisture permeable fiber sheet for a portion of a ceiling face sheet of an inner bag to thereby eliminate humidity, moisture and saturated damp air transpired from cargoes in the inner bag. However, not only such methods for preventing wet damage caused a problem of increase of the cost, and but also there was no method which could prevent wet damage perfectly. Therefore, in the case where cargoes containing, for example, bagged coffee beans, grains or the like were transported according to the prior art, there was a case where the cargoes got musty with the moisture transpired from the cargoes, or dew-drops generated therein caused wet damage, decomposition, rancidity, mold and so on were produced in the cargoes due to generation of dew-drops. In addition, there was a case where water leaking from the outside of the container due to the defect of the container per se enters the container to cause wet damage. Wet damage caused by dew-drops inside a container was a serious problem in transportation of cargoes by ship in import and export where it is inevitable to sail across areas having a large temperature difference or having a large change in humidity.

SUMMARY OF THE INVENTION

It is therefore an object of the present invention to solve the foregoing problems in the prior art.

It is another object of the present invention to provide an apparatus for preventing wet damage caused by dew-drops generated inside a container, in which when cargoes of grains, fruits, etc. such as coffee beans having a high moisture content are transported as bulk cargoes by using an inner bag in a dry container, wet damage caused by dew-drops or damage caused by dry rot, decomposition, rancidity, mold, and so on, generated by saturated air can be prevented from occurring in the cargoes loaded in the inner bag.

In order to achieve the foregoing objects, according to an aspect of the present invention, provided is an apparatus for preventing wet damage caused by dew-drops inside a hexahedral container, comprising: a plurality of suspending rings attached onto inner wall surface portions of the container; an inner bag constituted by a ceiling face, a bottom face, two side faces, a front face and a rear face so as to be shaped into a hexahedron, the inner bag having a loading opening formed in one of the side walls for loading cargoes; a plurality of suspending hooks or strings provided on the inner bag so as to be hooked or knotted on the plurality of suspending rings of the container so that the inner bag loaded with the cargoes is suspended inside the container in a manner so as to keep its hexahedral shape substantially while an air gap where air can circulate is left at least between the ceiling face of the inner bag and an inner wall portion of a ceiling portion of the container; an absorptive sheet attached on an outside of the ceiling face of the inner bag; an air permeable sheet attached to portions which are vicinities of upper areas of at least the side faces and rear face, partially or wholly, of the inner bag to which air permeability is given so that air inside the inner bag can circulate through the air permeable sheet; a waterproof polyester sheet added by contact bonding or sewing to portions of the inner bag, except the vicinities of the upper areas and the loading opening, so as to have a waterproof function; and an openable/closable cover provided at the loading opening.

In the above wet-damage preventing apparatus, preferably, air permeability is given to the vicinities of the upper areas of the side faces and front and rear faces, partially or wholly, of the inner bag, and the air permeable sheet for circulating the air inside the inner bag is attached to the region to which air permeability is given.

In the above wet-damage preventing apparatus, preferably, a waterproof sheet is attached to an outside of the bottom face of the inner bag partially or wholly.

In the above wet-damage preventing apparatus, preferably, edges of a waterproof sheet attached to an outside of the bottom face of the inner bag partially or wholly are put up near lower areas of the side faces and front and rear faces of the inner bag.

In the above wet-damage preventing apparatus, preferably, the loading opening of the inner bag is made to have a size corresponding to the whole of the front face.

In the above wet-damage preventing apparatus, preferably, the cover is made openable and closable by means of a fastener.

In the above wet-damage preventing apparatus, preferably, the cover is made closable by means of a bonding tape.

In the above wet-damage preventing apparatus, preferably, the cover is made closable by means of a bonding agent.

Thus, air permeability is given to the vicinity of the upper areas of opposite side faces and a rear face or of the opposite sides and rear and front faces, partially or wholly, of the inner bag, and an air permeable sheet for circulating the air is attached to the region to which air permeability is given. Thus, saturated damp air in the inner bag is guided easily, by natural circulation, to the outside of the bag, particularly to the ceiling wall of a container easily, so as to generate dew-drops on the metal surface of the ceiling wall of the container. The dew-drops fall down so as to be absorbed into a high polymeric absorptive sheet or a fibrous absorptive sheet attached to the outside of the ceiling face of the inner bag, and the absorbed dew-drops are solidified into gel. Thus, the relative humidity in the container is reduced. Further, a waterproof sheet is attached to the outside of the bottom face of the inner bag in order to increase the effect of preventing wet damage, so that dew-drops falling down along the side wall of the container is prevented from entering the inner bag in the container. Thus, damage caused by water of the dew-drops is prevented perfectly to protect the bulk cargoes loaded in the inner bag from wet damage, etc.

That is, air permeability is given to the vicinity of the upper areas of the opposite side faces and a rear face or of the opposite side faces and rear and front faces, partially or wholly, of an inner bag suspended inside a container, and an air permeable sheet is attached to the region to which air permeability is given. Thus, saturated air transpired from coffee beans, grains or the like in the bag can be circulated naturally in the outside of the bag so as to be formed into dewdrops. The dew-drops falling down can be absorbed into an absorptive sheet attached to the outside of the ceiling face of the inner bag and solidified into gel.

Because the dew-drops absorbed into the absorptive sheet is solidified into gel, there is no fear that moisture which has once been absorbed transpires again, so that the humidity inside the container is reduced surely.

The dew-drops or water drops formed on the metal portion of the side wall portion inside the container flow down as they are along the side wall portion. However, the inner bag is formed from a polyester waterproof sheet, and permeation of moisture or the like through seams is prevented by contact bonding and sewing, so that water can be surely prevented from entering the inner bag. Thus, wet damage of the cargoes can be excluded perfectly.

DETAILED DESCRIPTION OF THE PREFERRED EMBODIMENT

Figure 1A:
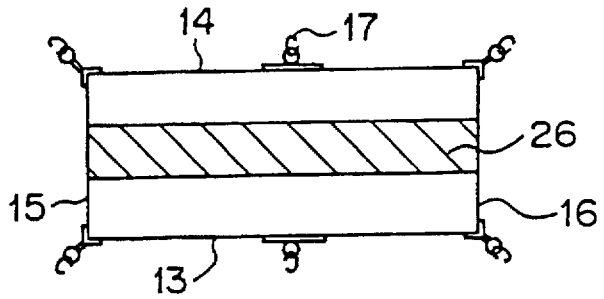
FIG. 1A is a plan view illustrating an inner bag used in an apparatus for preventing wet damage caused by dew-drops inside a container according to the present invention.
Figure 1B:
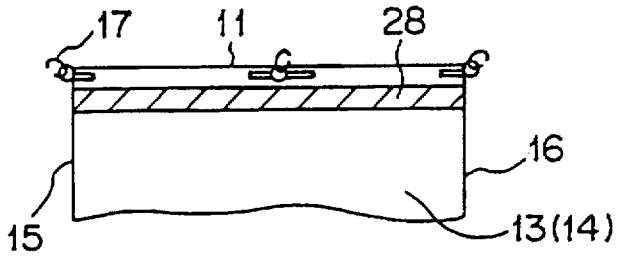
FIG. 1B is a side view showing only the vicinity of the upper area of the inner bag.
Figure 1C:
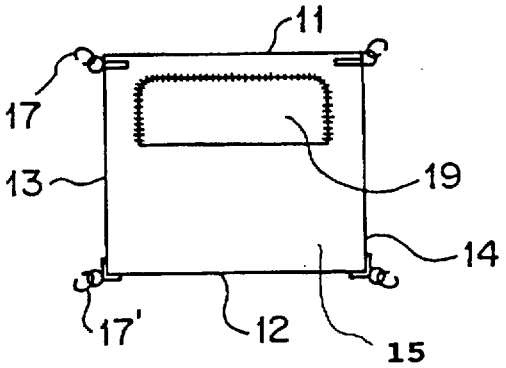
Fig. 1C is a front view of the inner bag.
Figure 1D:
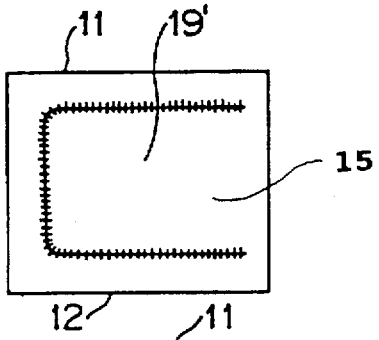
Fig. 1D is a view similar to FIG. 1C, showing an arrangement of a cover different from that in Fig. 1C.
Figure 1E:
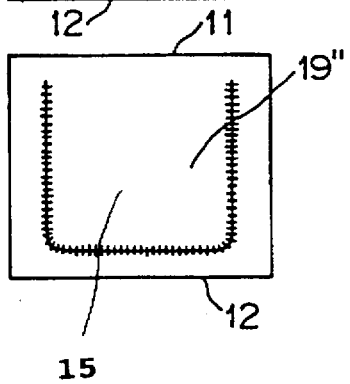
FIG. 1E is a view similar to Fig. 1C, showing another arrangement of the cover different from that in Fig. 1C.

Other features, advantages and details of the present invention will be described in detail with reference to the drawings showing an embodiment thereof.

The present invention will be described with reference to an embodiment shown in FIGS. 1A to 1E, FIG. 2 and FIGS. 3A to 3B.

As shown in the drawings, a plurality of suspending rings 4 are attached to the container wall surface inside a container 1. An inner bag 10 is formed into a hexahedron constituted by a ceiling face 11, a bottom face 12, a front face 13, a rear face 14, and side faces 15 and 16. Air holes in the form of meshes or apertures are provided, partially or wholly, in the vicinity of upper areas of at least three peripheries of the inner bag 10, that is, the rear face 14 and the side faces 15 and 16, or in the vicinity of upper areas of four peripheries of the inner bag 10, that is, the front face 13, the rear face 14 and the side faces 15 and 16 so that air permeability is given to the inner bag 10, and an air permeable sheet, particularly an air permeable fiber sheet 28, may be attached to the area to which air permeability is given in this manner. The side face 15 of the inner bag 10 has an opening 18 for loading a cargo 20. Excepting the areas where the air permeable fiber sheet 28 is attached, the inner bag 10 is formed from a waterproof polyester sheet, and the above-mentioned hexahedron is formed by contact bonding and sewing of the polyester sheet so as to have a waterproof function to prevent moisture from entering the inner bag 10 through seams of the sheet. The inner bag 10 has a plurality of suspending hooks 17 and 17' in its upper and lower portion. This is because it is necessary to enable the inner bag 10 to be suspended lest the top is used as the bottom for the sake of convenience in handling of cargoes. The suspending hooks 17 and 17' are hooked on a plurality of suspending rings 4 provided inside a container 1, so that the inner bag 10 is suspended inside the container 1 while an air gap where the air can circulate is left at least between a ceiling wall 2 of the container 1 and the inner bag 10. The cargo loading opening 18 formed in the side face 15 of the inner bag 10 is provided with a cover 19 which can be opened and closed by a fastener, or can be closed by a bonding tape or a bonding agent. Since it is necessary to change the size of the loading opening 18 in accordance with the kind of the cargo to be loaded, the loading opening 18 may be formed as wide as substantially the whole of the side face 15 of the inner bag 10 as shown by the reference numerals 19' and 19", in Figs. 1D and 1E, other than that shown in FIG. 2 or 1C.

Figure 2:
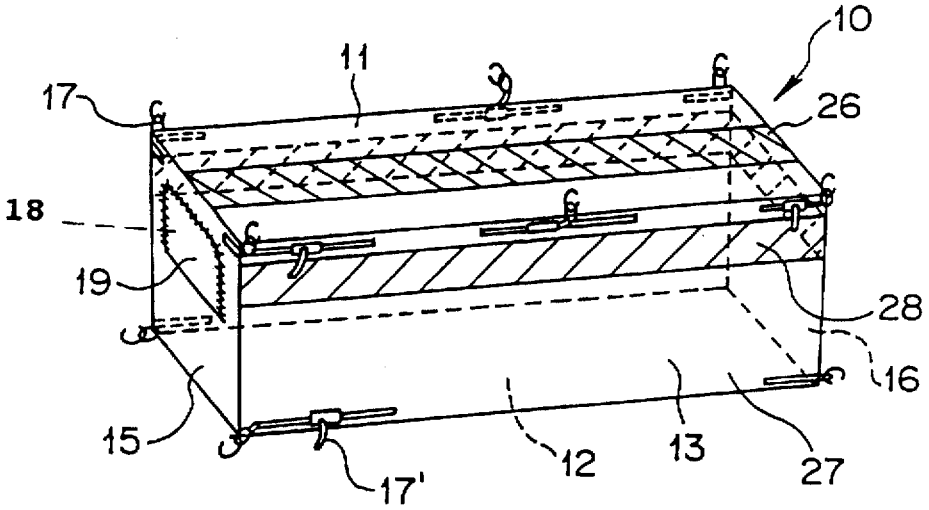
FIG. 2 is a perspective view illustrating a state where the inner bag used in an apparatus for preventing wet damage caused by dew-drops inside a container according to the present invention has not been loaded into the inside of a container yet.

A high polymeric water absorptive sheet 26 is attached to the ceiling face 11 of the inner bag 10, and a waterproof sheet 27 which is water repellent is attached on the outside of the bottom face 12 of the inner bag 10. In FIG. 2, the inner bag 10 with the water absorptive sheet and so on attached thereto as mentioned above is shown in perspective view. The waterproof sheet 27 may be attached to the vicinity of the upper area of the bottom face 12 of the inner bag 10, partially or wholly, and its edges may be stood up to the vicinity of the lower areas of the front face 13, the rear face 14, and the side faces 15 and 16 of the inner bag 10 if occasion demands.

Figure 3A:
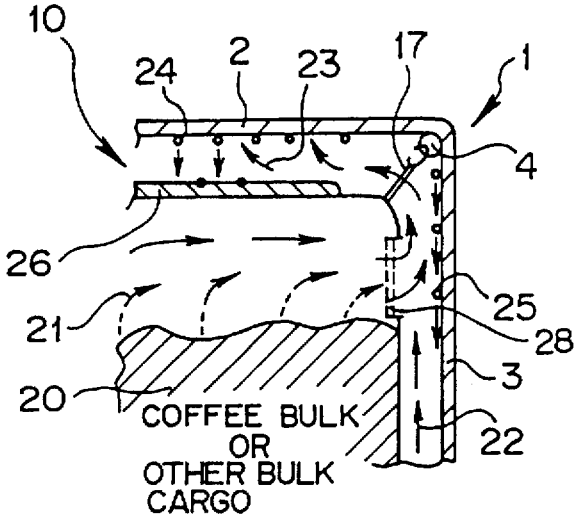
FIG. 3A is a partially expanded sectional front view showing circulation of an air layer inside an apparatus for preventing wet damage caused by dew-drops inside a container according to the present invention.
Figure 3B:
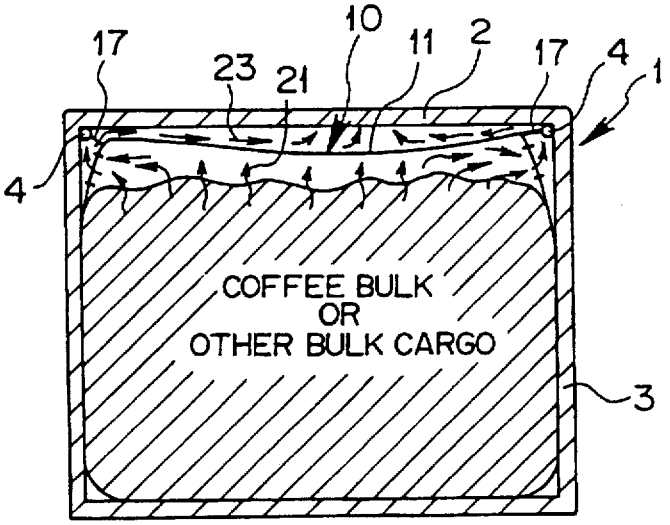
FIG. 3B is a front sectional view of the same.

FIGS. 3A and 3B show the state where the inner bag 10 of FIG. 2 has been installed inside the container 1. The suspending hooks 17 and 17' or strings provided additionally in the upper and lower portions of the inner bag 10 are hooked or knotted on the suspending rings 4 of metal provided inside the container 1, so that the inner bag 10 is suspended inside the container 1 like a mosquito net. Coffee beans, grains or the like 20 have been loaded in the inner bag 10 as bulk materials.

In FIGS. 3A and 3B, a saturated air flow transpired from the coffee beans, grains or the like 20 and leaking through the ceiling face 11 of the inner bag 10 is indicated by an arrow 21, and a saturated air flow leaking through the air permeable fiber sheet 28 from a part or whole of the upper areas of the side faces 13 and 14, and the front and rear faces 15 and 16 of the inner bag 10 is indicated by an arrow 22. The saturated air flows 21 and 22 appear between the ceiling face 11 of the inner bag 10 loaded with the coffee beans, grains or the like 20 and the ceiling wall 2 of the container 1, and come into contact with the metal surface of the ceiling wall 2 of the container 1 so as to be cooled adiabatically, condensed into dew-drops 24. The dew-drops 24 fall down and are absorbed by the water absorptive sheet 26 attached to the ceiling face 11 of the inner bag 10. On the other hand, the saturated air flow 22 contacting with the metal surface of a side wall 3 of the container 1 is condensed thereon so as to form dew-drops 25. Falling down and reaching the bottom portion of the container 1, the dew-drops 25 are repelled by the waterproof sheet 27 attached to the outside of the bottom face 12 of the inner bag 10. Thus, the dew-drops are prevented from entering the inner bag 10.

According to an apparatus for preventing wet damage caused by dew-drops inside a container according to the present invention, bulk cargoes loaded inside an inner bag suspended in a container can be perfectly prevented from suffering damage caused by dry rot and dew-drops due to damp, moisture, or the like, transpired from the cargoes per se.

By use of the inner bag according to the present invention, it is possible to prevent wet damage caused by dry rot or dewdrops due to saturated damp air from cargoes in the inner bag, it is possible to reduce the damage rate in conventional bagged transportation on a large scale, and it is possible to expect that insurance fee also become cheaper. Thus, the merit due to reduction of the transportation cost for bulk transportation is inestimable.

The present invention is the most optimum for bulk transportation of coffee bean, grains, or the like, and has merits such as reduction in transportation cost, elimination of cargo wet-damage, etc., in comparison with conventional bagged transportation.

By the apparatus according to the present invention, not only coffee beans, of course, but also various grains, fruits, vegetables, etc., or other cargoes which dislike wet damage can be prevented perfectly and more inexpensively from suffering moisture, wet damage etc., of cargoes in the inner bag.

Since dew-drops are absorbed by a water absorptive sheet and solidified, the dew-drops which have been once absorbed are prevented from transpiring to generate dew-drops again. Accordingly, the humidity inside the container can be reduced surely so as to make it possible to perfectly protect the cargoes from damage due to dew-drops and damage due to moisture.

By the apparatus according to the present invention, even if cargoes having a high water content are loaded in the inner bag, it is possible to prevent generation of musty loss in the bag and wet damage due to dew-drops, and it is possible to obtain transportation merit owning to bulk transportation. With respect to any other cargoes, it is also possible to prevent wet loss due to dew-drops or due to container's defect, and the apparatus contributes to safe transportation of the cargoes.

By use of a high polymeric water absorptive sheet, it is possible to obtain a high-performance water absorptive sheet having a capacity of absorbing water of 3 to 6 liters per 1 $m^3$. In addition, the inner bag is adapted to target cargoes so as to contribute to reduction in cost.

It is possible to expect such a merit that insurance fee for coffee beans, grains and so on, which has been high, can be reduced hereafter.

By use of an apparatus for preventing wet damage due to dewdrops inside a container according to the present invention, the mode of transportation of cargoes, particularly grains which are easy to absorb and transpire moisture, or coffee beans shipped from Indonesia, Thailand, Vietnam, Brazil, Colombia, etc. can be changed from the conventional bagged transportation mode to the bulk transportation mode. Accordingly, it becomes possible to carry out bulk transportation using an inner bag in a container.

It is possible to perform shipping from the above-mentioned areas to Japan or any other areas without any problem.

Transportation from areas with high temperature and high humidity, and use in areas with a large temperature difference between daytime and nighttime and in areas where production of dew-drops can be foreseen can be promoted, so that it is possible to solve a world-wide serious problem on transportation by means of dry containers.

What is claimed is:

1. An apparatus for preventing wet damage caused by dew-drops inside a hexahedral container, comprising:

a plurality of suspending rings attached onto inner wall surface portions of said container; and an inner bag constituted by a ceiling face, a bottom face, two side faces, a front face and a rear face so as to be shaped into a hexahedron, said inner bag having a loading opening formed in one of said side faces for loading cargoes;

a plurality of suspending hooks or strings provided on said inner bag so as to be hooked or knotted on said plurality of suspending rings of said container so that said inner bag loaded with said cargoes is suspended inside said container in a manner so as to keep its hexahedral shape substantially while an air gap where air can circulate is left at least between said ceiling face of said inner bag and an inner wall portion of a ceiling portion of said container;

an absorptive sheet attached on an outside of said ceiling face of said inner bag;

an air permeable sheet attached to portions which are vicinities of upper areas of at least said side faces and rear face, partially or wholly, of said inner bag to which air permeability is given so that air inside said inner bag can circulate through said air permeable sheet;

a waterproof polyester sheet added by contact bonding or sewing to portions of said inner bag, except said vicinities of said upper areas and said loading opening, so as to have a waterproof function; and an openable/closable cover provided at said loading opening.

2. An apparatus for preventing wet damage caused by dew-drops inside a container according to claim 1, wherein air permeability is given to the vicinities of the upper areas of said side faces and front and rear faces, partially or wholly, of said inner bag, and said air permeable sheet for circulating the air inside said inner bag is attached to the region to which air permeability is given.

3. An apparatus for preventing wet damage caused by dew-drops inside a container according to claim 1 or 2, wherein a waterproof sheet is at least partially overlapped additionally to an outside of said bottom face of said inner bag.

4. An apparatus for preventing wet damage caused by dew-drops inside a container according to claim 1 or 2, wherein edges of a waterproof sheet overlapped additionally to an outside of said bottom face of said inner bag partially or wholly are put up near lower areas of said side faces and front and rear faces of said inner bag.

5. An apparatus for preventing wet damage caused by dew-drops inside a container according to claim 1 wherein a waterproof sheet is at least partially overlapped additionally to an outside of said bottom face of said inner bag, and, said loading opening of said inner bag is made to have a size corresponding to the whole of said front face.

6. An apparatus for preventing wet damage caused by dew-drops inside a container according to claim 1 wherein a waterproof sheet is at least partially overlapped additionally to an outside of said bottom face of said inner bag disposed near lower areas of said side, front and rear faces of said inner bag, and, said loading opening of said inner bag is made to have a size corresponding to the whole of said front face.

7. An apparatus for preventing wet damage caused by dew-drops inside a container according to any of claims 1,2,5 or 6, wherein said cover is made openable and closable by means of a fastener.

8. An apparatus for preventing wet damage caused by dew-drops inside a container according to any of claims 1,2,5 or 6, wherein said cover is made closable by means of a bonding tape.

9. An apparatus for preventing wet damage caused by dew-drops inside a container according to any of claims 1,2,5 or 6, wherein said cover is made closable by means of a bonding agent.

* * * * *